United States Patent [19]

Muramatsu et al.

[11] Patent Number: 4,492,202

[45] Date of Patent: Jan. 8, 1985

[54] FUEL INJECTION CONTROL

[75] Inventors: Toshihiko Muramatsu; Akio Kobayashi; Toshio Kondo; Shigenori Isomura; Tomomi Eino, all of Kariya, Japan

[73] Assignee: Nippondenso Co., Ltd., Kariya, Japan

[21] Appl. No.: 460,856

[22] Filed: Jan. 25, 1983

[30] Foreign Application Priority Data

Jan. 29, 1982 [JP] Japan ..... 57-13133

[51] Int. Cl.[3] ..... F02B 3/00; F02B 3/04

[52] U.S. Cl. ..... 123/478; 123/480; 123/486

[58] Field of Search ..... 123/478, 480, 486, 417; 364/431

[56] References Cited

U.S. PATENT DOCUMENTS

| | | | |
|---|---|---|---|
| 3,969,614 | 7/1976 | Moyer et al. | 123/480 |
| 4,309,971 | 1/1982 | Chiesa et al. | 123/486 |
| 4,319,327 | 3/1982 | Higashiyama et al. | 123/480 |
| 4,335,695 | 6/1982 | Phipps | 123/478 |
| 4,345,561 | 8/1982 | Kondo et al. | 123/486 |
| 4,348,727 | 9/1982 | Kobayashi et al. | 123/480 |
| 4,348,728 | 9/1982 | Sagisaka et al. | 123/480 |
| 4,359,992 | 11/1982 | Asano et al. | 123/486 |
| 4,366,541 | 12/1982 | Mouri et al. | 123/486 |
| 4,413,602 | 11/1983 | Inoue et al. | 123/486 |

*Primary Examiner*—Raymond A. Nelli

*Attorney, Agent, or Firm*—Cushman, Darby & Cushman

[57] ABSTRACT

A fuel injection control for an internal combustion engine having electromagnetic fuel injectors determines a basic fuel injection time width of a fuel injection pulse signal applied to the electromagnetic fuel injectors in accordance with detected conditions of engine operation parameters, stores maximum fuel injection time width values predetermined in correspondence to values of a predetermined one of the engine operation parameters, reads one of the predetermined maximum fuel injection time width values corresponding to the values of the predetermined engine operation parameter and corrects the same in accordance with the values of the other engine operation parameters, and corrects the basic fuel injection time width in accordance with the corrected predetermined maximum fuel injection time width value, thereby controlling the air-fuel ratio at a desired air-fuel ratio under every operating condition of the engine, while simultaneously preventing a misoperation of continuous fuel supply from occuring in the electromagnetic fuel injectors as before.

3 Claims, 12 Drawing Figures

$t_{Pmax_1}$ TABLE

| | | | | | | | | | | |
|---|---|---|---|---|---|---|---|---|---|---|
| 3.52 | 3.56 | 3.67 | 3.78 | 3.74 | 3.75 | 3.82 | 3.86 | 3.85 | 3.74 | 3.58 |
| 8 | 12 | 14 | 20 | 24 | 28 | 32 | 36 | 40 | 44 x $10^2$ | |

ENGINE SPEED N (rpm)

FUEL INJECTION CONTROL

BACKGROUND OF THE INVENTION

1. Field of the Invention

The present invention relates to an electronic fuel injection control in which the basic fuel injection quantity for each fuel injection valve of an internal combustion engine under a high load condition is controlled to control the air-fuel ratio (A/F).

2. Description of the Prior Art

In known electronically controlled fuel injection systems of the type which controls the opening time length of electromagnetic fuel injection valves for intermittently supplying fuel to an engine, for example, an electronically controlled fuel injection system of the mass flow type, the opening time length T of each electromagnetic fuel injection valve is computed from an equation $T=t_p\times K_1$. Here, $t_p$ represents a basic fuel injection pulse width and it is determined by the division of an engine intake air quantity Q by an engine speed N. $K_1$ represents a correction factor determined by outputs of various sensors, for example, a water temperature sensor, and $t_p$ is multiplied by $K_1$ to provide a value of A/F which is purposely made to deviate from a value of A/F determined by a value of $t_p$.

As regards the value of the basic fuel injection pulse width $t_p$, it has been an usual practice to preset a fixed maximum value $t_{pmax}$ for the value of $t_p$ so as to prevent the misoperation of continuous fuel supply from occurring in the electromagnetic fuel injection valves for some reason or other.

A disadvantage of conventional electronically controlled fuel injection systems is that intake air pulsations occurring under a heavy engine load condition are transmitted directly to an air flow meter (an intake air quantity sensor), so that a measuring plate of the air flow meter is opened excessively due to its misoperation. As a result, a basic fuel injection pulse width $t_p$, which exceeds a fuel supply quantity corresponding to an actual air flow quantity, is computed and an excessive quantity of fuel is supplied from the electromagnetic injection valve, thereby causing an over rich fuel mixture problem. Accordingly, it has been impossible to control the air-fuel ratio under heavy load conditions, thereby resulting in variations in the engine power output, etc. FIG. 6, which will be described later, shows an example of the relation between the over rich rate and the engine speed at the fully open throttle valve position in a conventional fuel injection system. It will be seen from the Figure that the conventional system has a disadvantage of increasing the over rich rate. This invention has been made with a view to overcoming the foregoing deficiencies of the prior art.

SUMMARY OF THE INVENTION

It is an object of this invention to provide a fuel injection control for determining, in accordance with the detected operating conditions, that is, operation parameters of an engine having electromagnetic fuel injection valves, a basic fuel injection time width of a fuel injection pulse signal which is applied to the electromagnetic fuel injection valves, storing maximum fuel injection time width values predetermined correspondingly to the respective values of a preselected one of the engine operation parameters, reading one of the predetermined maximum fuel injection time width values corresponding to the value of the preselected engine operation parameter and correcting the read predetermined maximum fuel injection time width values in accordance with the values of the other engine control parameters, and correcting the determined basic fuel injection time width in accordance with the corrected predetermined maximum fuel injection time width value, thereby controlling the air-fuel ratio at a desired air-fuel ratio under all engine operating conditions and still simultaneously preventing the misoperation of continuous fuel supply from occurring in the electromagnetic fuel injection valves as in the past.

Muramatsu et al U.S. Patent Application Ser. No. 390,963, filed on June 22, 1982, is a copending application related to the fuel injection control method of this invention. In the invention of the copending application, a predetermined maximum fuel injection time width value corresponding to each of the values of a preselected one of the engine operation parameters is used straightly as it is to correct the basic fuel injection time width. As mentioned above, this invention is an improvement in this respect because the predetermined maximum fuel injection time width values are corrected in accordance with the values of the engine operation parameters other than the predetermined engine operation parameter and the corrected values are used for correcting the basic fuel injection time width, thereby controlling the air-fuel ratio at a desired air-fuel ratio under all engine operating conditions more precisely.

FIG. 7 which will be described later, shows the relation of the basic fuel injection time width $t_p$ and the air-fuel ratio A/F versus the engine speed during a heavy engine load operation with respect to both cases of the prior art and the present invention, which illustrates that the air-fuel ratio can be controlled at a desired air-fuel ratio by the use of the method of this invention which will be described hereinafter.

DESCRIPTION OF THE PREFERRED EMBODIMENTS

The present invention will now be described in greater detail with reference to the embodiments shown in the accompanying drawings.

Figure 1:
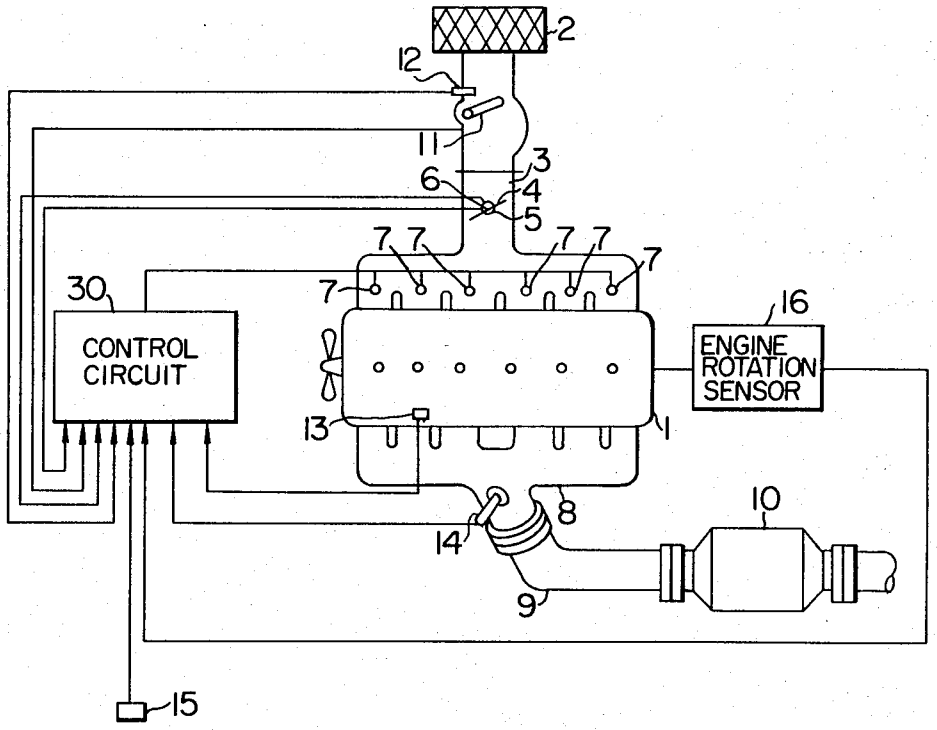
FIG. 1 is a schematic diagram showing the overall construction of an embodiment of the present invention.

In FIG. 1 showing the construction of an apparatus for the fuel injection control of this invention, an engine 1 is a known type of four-cycle spark ignition engine mounted on automotive vehicles and it takes in air for combustion therein by way of an air cleaner 2, an intake pipe 3 and a throttle valve 4. A throttle opening sensor 5 for detecting an opening degree of the throttle valve 4 is provided. The throttle opening sensor 5 is provided with an idling switch 6 which operates to produce a voltage when the engine is idling but no voltage when the engine is in the other operating conditions, thereby detecting the idling condition and generating an idling signal. Fuel is supplied from a fuel supply system (not shown) through electromagnetic fuel injectors (injection valves) 7 which are provided in respective engine cylinders. After each combustion, exhaust gases are discharged into the atmosphere via an exhaust manifold 8, an exhaust pipe 9, a three-way catalytic converter 10, etc. The intake pipe 3 is provided with a potentiometer type intake air quantity sensor 11 for detecting a quantity of intake air supplied to the engine 1 to generate an analog voltage corresponding to the intake air quantity and a thermistor type intake air temperature sensor 12 for detecting a temperature of intake air to generate an analog voltage (analog detection signal) corresponding to the intake air temperature. The engine 1 is provided with a thermistor type water temperature sensor 13 for detecting a temperature of engine cooling water to generate an analog voltage (analog detection signal) corresponding to the cooling water temperature. There is attached to the exhaust manifold 8 an air-fuel ratio sensor 14 for detecting an air-fuel ratio from an oxygen content in the exhaust gases so that a signal voltage of about 1 volt (a high level) is produced when the air-fuel ratio is smaller (richer) than a stoichiometric ratio and a signal voltage of about 0.1 volt (a low level) is produced when the air-fuel ratio is greater (leaner) than the stoichiometric ratio. An atmospheric pressure sensor 15 detects atmospheric pressure and outputs a voltage signal indicative of the atmospheric pressure. An engine rotation sensor 16 detects the rotation of a crankshaft of the engine 1 and produces a pulse signal in response to the rotation of the crankshaft. The engine rotation sensor 16 may be comprised, for example, of an ignition coil in the ignition system of the engine 1, whereby an ignition pulse signal from a primary terminal of the ignition coil may be used as an engine rotation signal. A control circuit 30 computes a fuel injection quantity on the basis of detection signals from the above-described sensors 5, 6 and 11 to 16 and the quantity of fuel injected is adjusted by controlling the opening time length of the electromagnetic fuel injectors 7.

Figure 2:
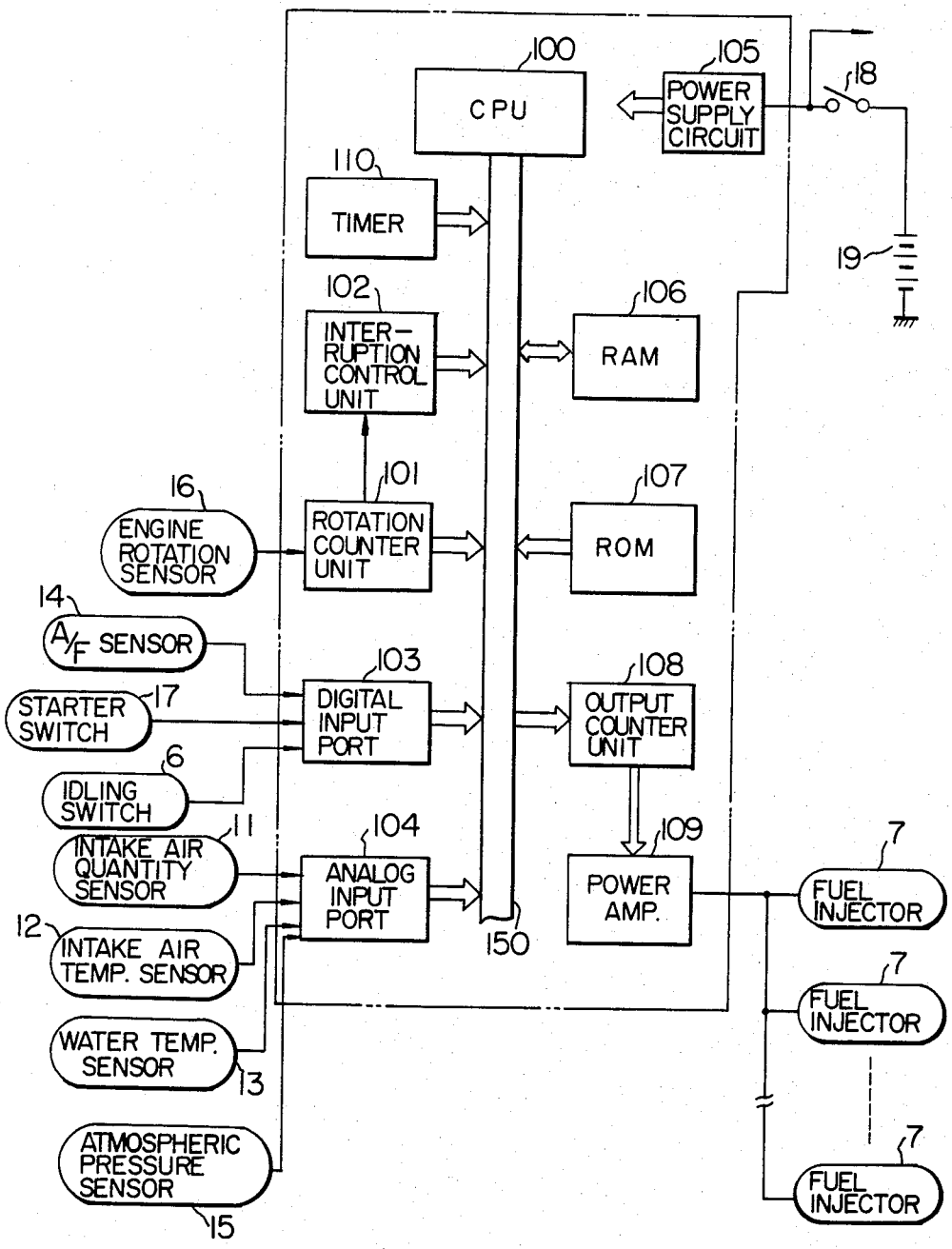
FIG. 2 is a block diagram of the control circuit shown in FIG. 1.

The control circuit 30 will be described with reference to FIG. 2. Numeral 100 designates a microprocessor (CPU) for computing a fuel injection quantity. Numeral 101 designates a rotation counter unit which responds to the signals from the engine rotation sensor 16 to count the engine rotation and generates a signal indicative of the engine speed N. Further, the rotation counter unit 101 operates to transmit an interruption command signal to an interruption control unit 102 in synchronism with the engine rotation. When the interruption control unit 102 receives the interruption command signal, it transmits an interruption request signal to the CPU 100 through a common bus 150. Numeral 103 designates a digital input port which transmits to the CPU 100 digital signals such as an output signal of a comparator which compares an output of the air-fuel ratio sensor 14 with a predetermined comparison level, a starter signal from a starter switch 17 which turns on and off a starter not shown, an output signal of the idling switch 6, etc. Numeral 104 designates an analog input port comprising an analog multiplexer and an A-D converter. The analog input port 104 operates so as to subject the respective output signals from the intake air quantity sensor 11, the intake air temperature sensor 12, the water temperature sensor 13 and the atmospheric pressure sensor 15 to A-D conversion and to have the results of the A-D conversion read by the CPU 100 sequentially. The output data from the units 101, 102, 103 and 104 are transmitted to the CPU 100 via the common bus 150. Numeral 105 designates a power supply circuit connected to a battery 19 through a key switch 18. Numeral 106 designates a random access memory (RAM) from which stored data are read and into which data are written. Numeral 107 designates a read-only memory (ROM) for storing programs, various constants, etc. Numeral 108 designates a fuel injection time controlling output counter unit including a register and it is formed by a down counter. The counter 108 converts a digital signal indicative of an opening time length of the electromagnetic fuel injectors 7, namely, a fuel injection quantity computed by the CPU 100, to a pulse signal having a pulse time width which provides an actual opening time length of the fuel injectors 7. Numeral 109 designates a power amplifier for driving the fuel injectors 7. Numeral 110 designates a timer, which measures an elapsed time and transmits the result of the measurement to the CPU 100.

The rotation counter unit 101 is responsive to the output signal of the engine rotation sensor 16 to measure the engine rotation once for every engine rotation. The counter 101 supplies an interruption command signal to the interruption control unit 102 upon completion of each measurement. In response to the interruption command signal the interruption control unit 102 generates an interruption request signal, which is supplied to the CPU 100 and causes the CPU 100 to execute an interruption processing routine for computing a fuel injection quantity.

Figure 3:
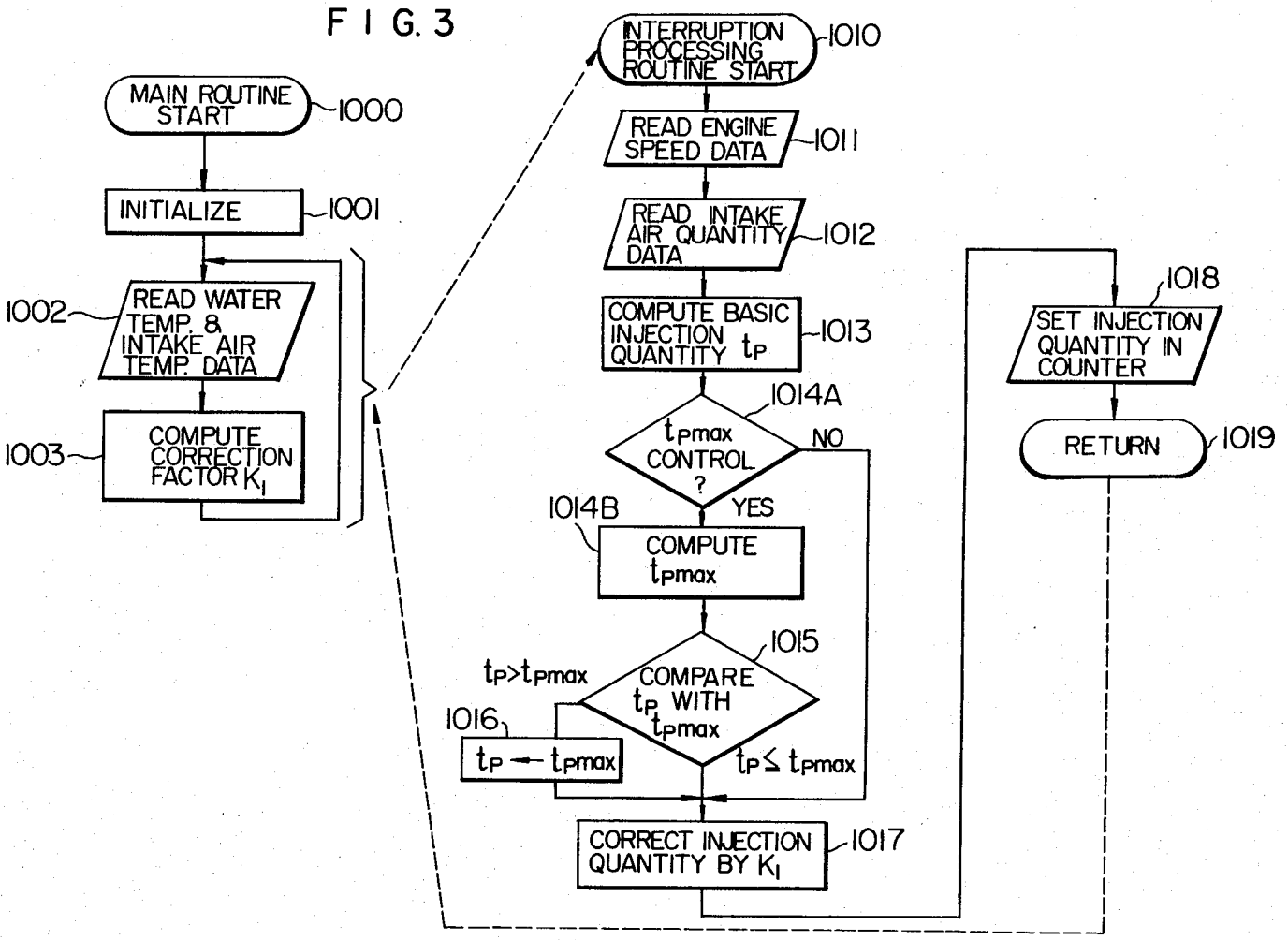
FIG. 3 is a diagram showing a simplified flow chart of the processing by the microprocessor shown in FIG. 2.

FIG. 3 shows a schematic flow chart for the processing by the CPU 100. The function of the CPU 100 as well as the operation of the whole apparatus will be described with reference to the flow chart. As the key switch 18 and the starter switch 17 are turned on to start the operation of the engine 1, the processing of a main routine is started at a step 1000, and a step 1001 effects the initialization for the processing. Then, at a step 1002 the digital values indicative of the cooling water temperature and the intake air temperature are read through the analog input port 104. A step 1003 computes a correction factor $K_1$ from the data obtained at the step 1002 and the result of the computation at the step 1003 is stored in the RAM 106. Upon completion of the operation at the step 1003, the processing returns to the step 1002. Usually, the CPU 100 repeats the processings of the steps 1002 and 1003 in the main routine shown in FIG. 3 in accordance with a control program. Upon receipt of an interruption request signal from the interruption control unit 102, even when the main routine is under execution, the CPU 100 immediately interrupts the execution of the main routine and causes the execution to jump to the interruption processing routine starting from a step 1010. A step 1011 reads a signal indicative of an engine speed N which is supplied from the rotation counter unit 101, and then a step 1012 reads a signal indicative of an intake air quantity Q from the analog input port 104. Then, a step 1013 computes a basic fuel injection quantity (or a basic fuel injection time width $t_p$ of the electromagnetic fuel injectors 7), which is determined by the engine speed N and the intake air quantity Q, and stores the result of the computation in the RAM 106. The computation is based on the equation: $t_p = F \times (Q/N)$ (where F is a constant).

A step 1014A determines whether a maximum value $t_{pmax}$ control is to be effected. If it is determined that the maximum value $t_{pmax}$ control is to be effected, the step 1014A branches to YES and the processing proceeds to a step 1014B. If the decision is negative, the step 1014A branches to NO and the processing jumps to a step 1017.

Figure 4B:
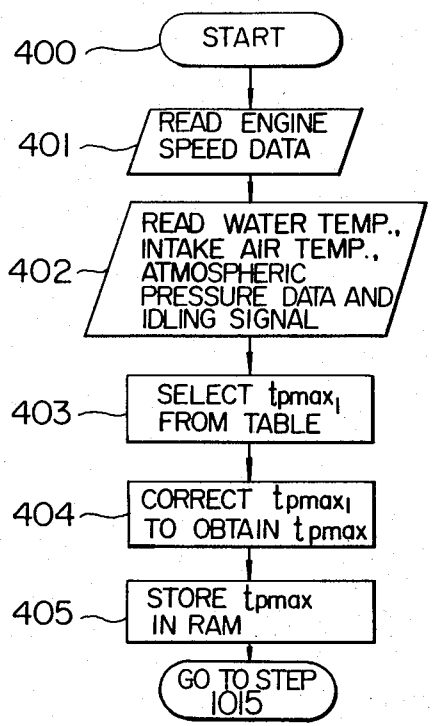
FIGS. 4A and 4B are diagrams showing respectively detailed flow charts for the steps 1014A and 1014B in the flow chart shown in FIG. 3.
Figure 4A:
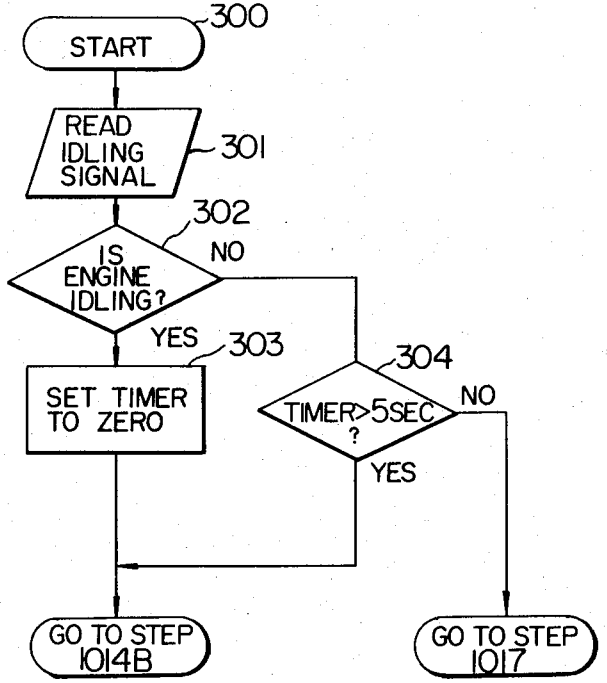
Figure 11:
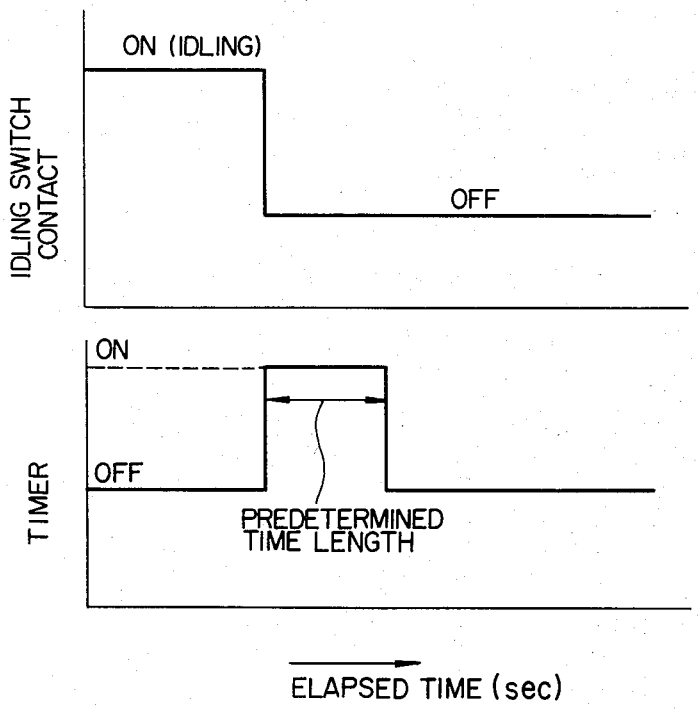

FIG. 4A shows a detailed flow chart of the processing step 1014A. The processing of the flow chart starts at a step 300. A step 301 reads the idling signal from the idling switch 6. A step 302 determines from the idling signal wheter the engine 1 is idling. More specificaly, it is determined that the engine 1 is in the idling state when the idling switch 6 is on as shown in FIG. 11. When the engine 1 is idling, the processing proceeds to a step 303 where the timer 110 is set to zero. Then, the processing proceeds to the step 1014B. If the engine is not idling, the step 302 branches to NO and the processing proceeds to a step 304. The step 304 determines whether the timer 110 indicates a count of less than 5 seconds (the predetermined time length shown in FIG. 11 is 5 seconds). If the count is less than 5 seconds, that is, if the time elapsed from the acceleration of the engine 1 departing from its idling state is less than 5 seconds, the processing jumps from the step 304 to the step 1017 thereby to remove restrictions by the maximum value $t_{pmax}$. On the other hand, if the elapsed time is longer than 5 seconds, the processing proceeds to the step 1014B to impose restrictions by the maximum value $t_{pmax}$.

Then, the step 1014B performs the computation of a maximum value $t_{pmax}$ of the basic fuel injection time width $t_p$.

Figures 5, 6:
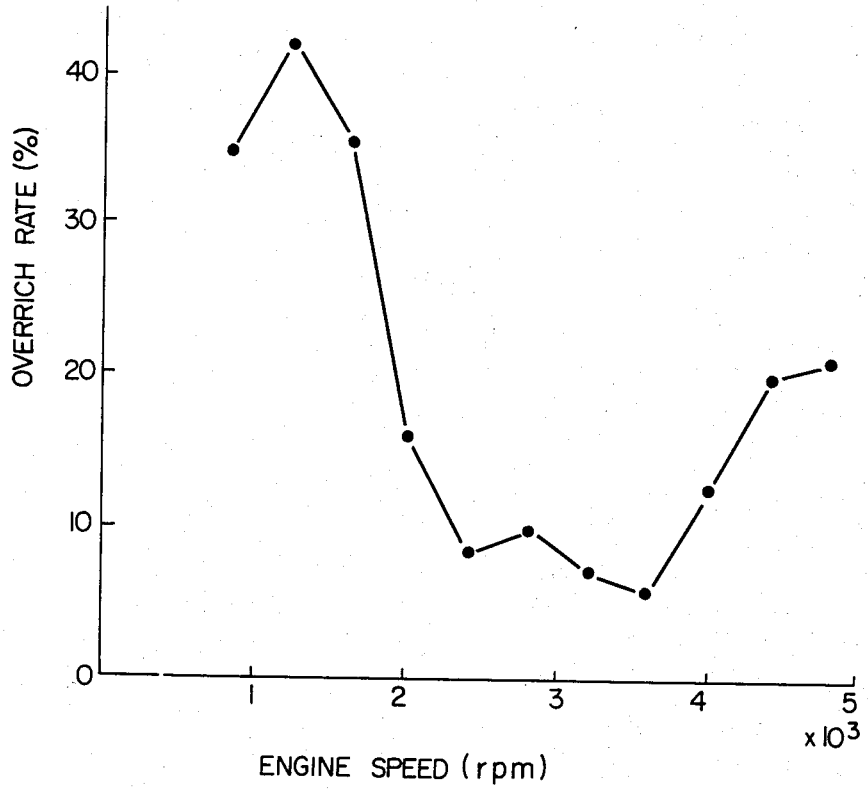
FIG. 5 is a diagram showing a table of maximum values $t_{pmax}$ of the basic fuel injection time width $t_p$ to be used for explaining the processings of the flow charts shown in FIGS. 4A and 4B.
FIG. 6 is a diagram showing the relation between the over rich rate and the engine speed at the fully open throttle valve position in a conventional fuel injection system.
Figure 7:
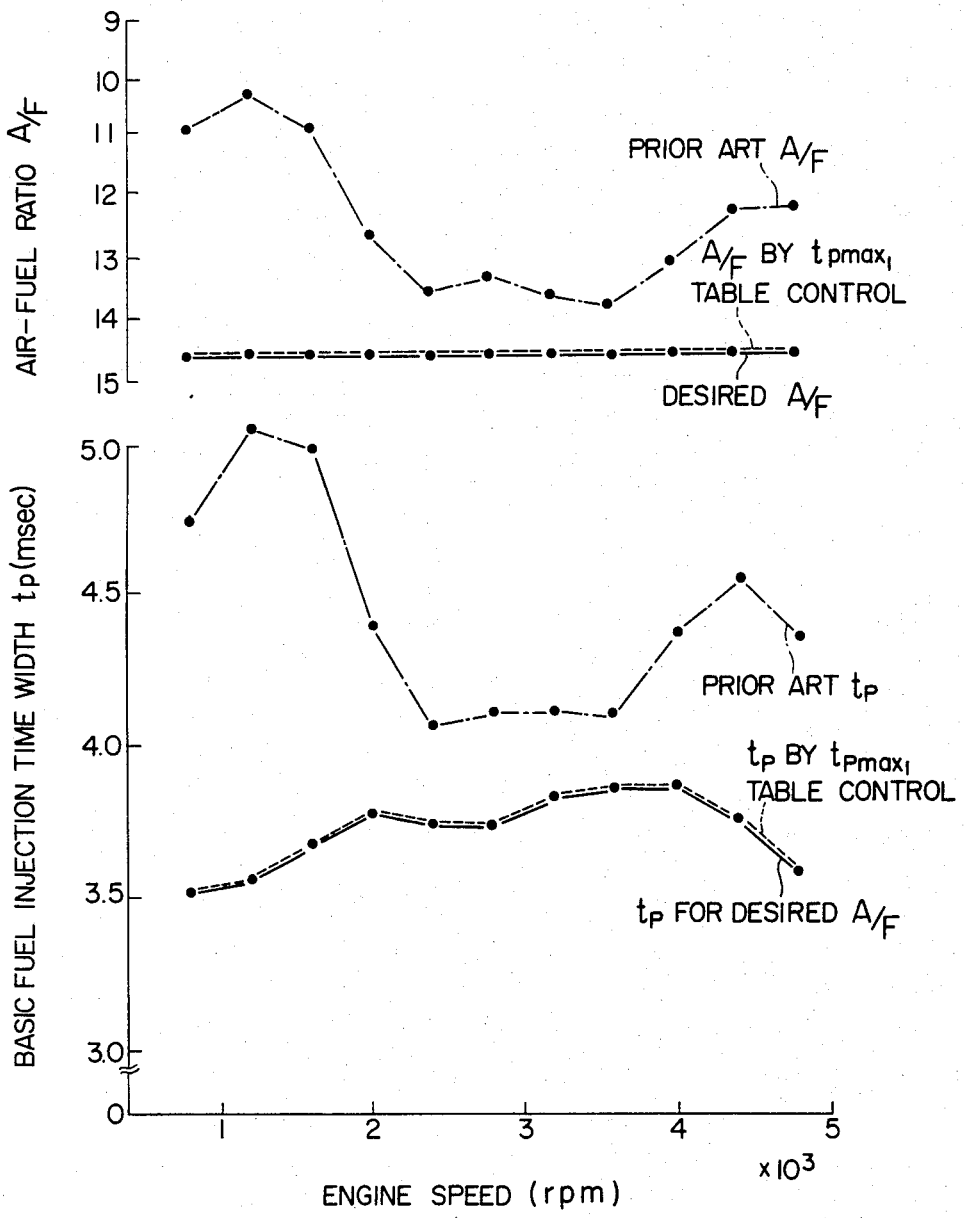
FIGS. 7 and 8 are diagrams showing variations of the air-fuel ratio A/F which are useful for explaining the meritorious effect of the embodiment of this invention.
Figure 8:
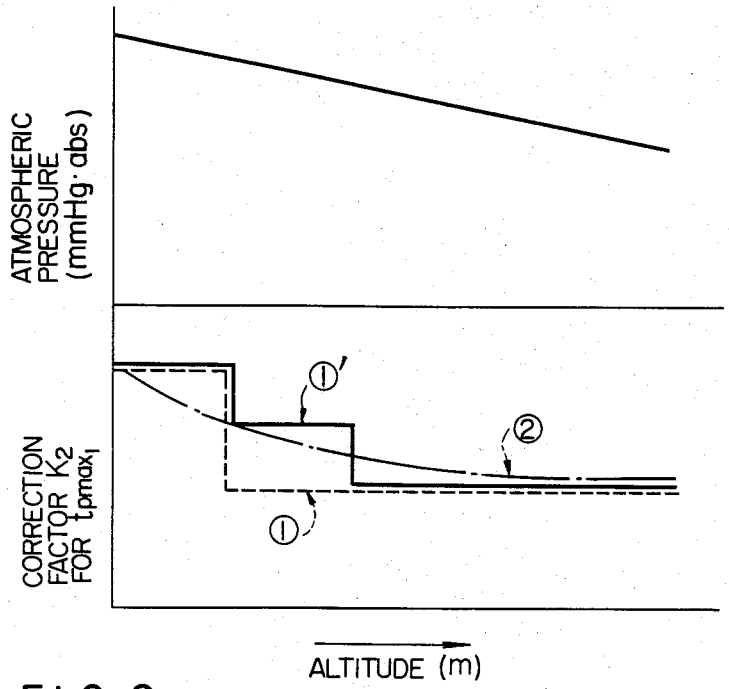
Figure 9:
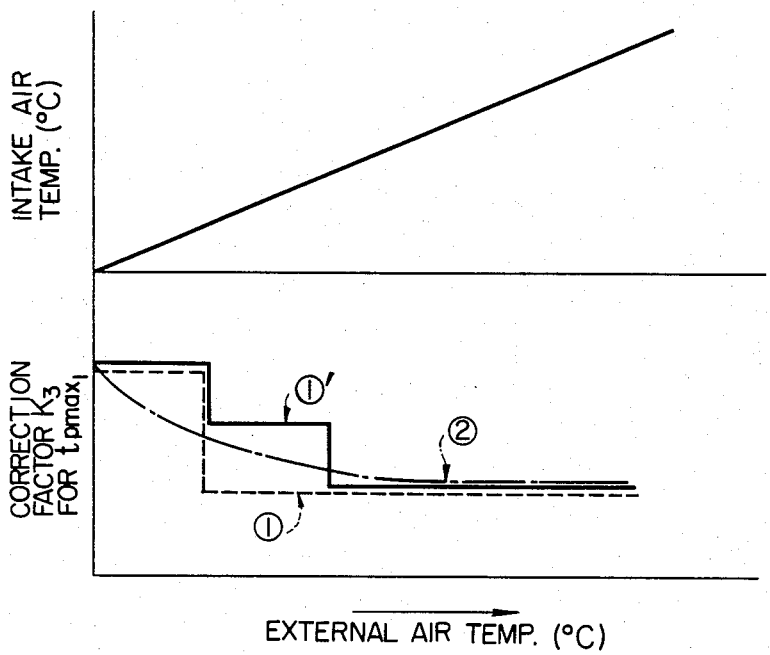
FIGS. 9, 10 and 11 are diagrams for explaining the other respective embodiments of this invention.
Figure 10:
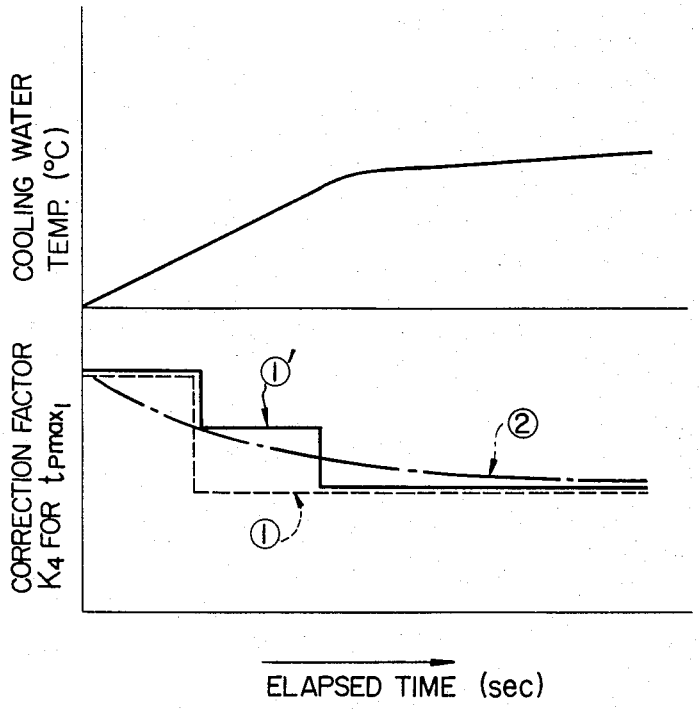

FIG. 4B shows a detailed flow chart of the processing step 1014B for the computation of $t_{pmax}$. The computation of $t_{pmax}$ starts at a step 400. A step 401 reads a signal indicative of the engine speed N from the rotation counter 101. Then, a step 402 reads signals indicative of the atmospheric pressure, the intake air temperature and the cooling water temperature from the analog input port 104 and a signal indicative of the idling state of the engine 1 from the digital input port 103. Then, a step 403 selects a corresponding $t_{pmaxl}$ value from a table shown in FIG. 5 tabulating the values of $t_{pmaxl}$ which have been predetermined to correspond to desired air-fuel ratios or approximate values thereof. This $t_{pmaxl}$ table is stored in the ROM 107. Then, a step 404 multiplies the selected $t_{pmaxl}$ value by the correction factors $K_2$, $K_3$ and $K_4$ predetermined in accordance with the atmospheric pressure, the intake air temperature and the cooling water temperature as shown in FIGS. 8, 9 and 10, respectively, to obtain a corrected maximum value $t_{pax}$. These correction factors $K_2$, $K_3$ and $K_4$ are stored in the ROM 107. Then, in a next step 405 the corrected maximum value $t_{pmax}$ is stored in the RAM 106 and the computation of $t_{pmax}$ ends, and the processing goes to a step 1015 in FIG. 3.

Here, the value of the correction factor $K_2$ is preferably preset to decrease with an increase of the altitude as shown in FIG. 8. Then, it becomes possible to prevent the over-enrichment of a gas mixture caused by the reduced air density at high altitudes. The value of the correction factor $K_3$ is preferably preset to decrease with an increase of the intake air temperature as shown in FIG. 9. Then, it becomes possible to absorb any influence exerted by the air density which varies as the temperature of intake air varies. The value of the correction factor $K_4$ is also preferably preset to decrease with an increase of the cooling water temperature as shown in FIG. 10. Then, it becomes possible to relax restrictions by $t_{pmax}$ during an engine operation when the engine 1 is cold, thereby enriching a gas mixture and thus preventing the gas mixture from becoming overlean during the cold engine operation.

The correction factors $K_2$, $K_3$ and $K_4$ may be preset in the digital manner to have at least one stepped change as shown at ① or ①' or in the analog manner as shown at ②, in FIGS. 8, 9 and 10, respectively. In this way, it becomes possible to change the value of $t_{pmax}$ during an engine operation at high altitudes, in the cold state, etc., where the engine 1 requires modified fuel consumption, so that the air-fuel ratio of the engine 1 may be controlled to meet every engine operating condition.

Then, the step 1015 reads the values of $t_p$ and $t_{pmax}$ from the RAM 106 and compares them with each other. If $t_p > t_{pmax}$, it is decided that the result of the computation of the basic fuel injection time width $t_p$ was incorrect, and the processing transfers to a step 1016. If $t_p \leqq t_{pmax}$, it is decided that the result of the computation of the basic fuel injection time width $t_p$ was correct, and the processing proceeds to the step 1017. When the processing has transferred to the step 1016, the value of $t_{pmax}$ used in the comparison is substituted for the value of $t_p$ and is used as a new basic fuel injection time width $t_p$, and then the processing proceeds to the step 1017. At the step 1017, the fuel injection correction factor $K_1$ obtained in the main routine is read from the RAM 106, and the processing is performed to correct the fuel injection time width (the fuel injection quantity) for determining an air-fuel ratio. The computation of the fuel injection time width T is based on the equation: $T = t_p \times K_1$. Next, a step 1018 sets the corrected fuel injection quantity data in the output counter unit 108. Then, the processing proceeds to a step 1019 and returns therefrom to the main routine. When the processing returns to the main routine, it returns to the processing at a step of the main routine which was interrupted previously for the purpose of interruption processing.

The general functions of the CPU 100 are as described above.

During a normal operation, the intake air quantity sensor 11 functions properly, and therefore the basic fuel injection time width $t_p$ for the electromagnetic fuel injectors 7 computed at the step 1013 is correct. Therefore, there is no need to correct the basic fuel injection time width $t_p$. Though the step 1015 compares the value of the basic fuel injection time width $t_p$ computed at the step 1013 with the value of $t_{pmax}$ computed at the step 1014B in FIG. 3, since the value of $t_{pmax}$ is preselected to be greater than the value of $t_p$, it is normally the case that no replacing of the value of $t_p$ occurs and the processing proceeds from the step 1015 to the step 1017.

During a heavy engine load operation, the basic fuel injection time width $t_p$ computed by the CPU 100 at the step 1013 in accordance with the output signal of the intake air quantity sensor 11 exceeds the value of $t_{pmax}$ corresponding to the desired air-fuel ratio, which causes an actual air-fuel ratio to become over rich. Accordingly, each time the engine speed is computed, selection is made from the predetermined values of $t_{pmaxl}$ and the selected value of $t_{pmaxl}$ is multiplied by the correction factors $K_2$, $K_3$ and $K_4$ corresponding to the atmospheric pressure, the intake air temperature and the cooling water temperature, respectively, to obtain a corrected $t_{pmax}$, and the corrected $t_{pmax}$ is used as the basic fuel injection time width $t_p$ in place of the value of $t_p$ computed by the CPU 100 at the step 1013 thereby to control the air-fuel ratio. By virtue of the above-described operation, it is possible to control the fuel injection quantity at proper values throughout the operating range of the engine 1.

Further, the same effect can also be obtained when using any engine load parameter other than the engine speed, e.g., the throttle valve opening, intake pipe pressure, intake air quantity, etc., or any combination thereof, as the parameter for predetermining the values of $T_{pmaxl}$.

Thus, the following remarkable meritorious effects can be obtained by the electronic fuel injection control according to this invention:

(1) A maximum fuel injection time width $t_{pmax}$ is determined by a value of $t_{pmaxl}$ which is selected from a $t_{pmaxl}$ table prearranged in accordance with the values of a preselected one of the engine operation parameters (e.g., the engine speed) and then multiplied by the values of correction factors predetermined in accordance with the engine operation parameters (e.g., the atmospheric pressure, the intake air temperature, the cooling water temperature and the state of the idling switch contact) other than the above-preselected engine operation parameters. As a result, it is possible to control the air-fuel ratio at a desired air-fuel ratio under every heavy load engine operating condition, such as the engine operations at high altitudes, in the cold state and in the state of acceleration.

(2) If a correction factor predetermined in accordance with an amount of deviation of an actual value of the air-fuel ratio from the control center value thereof is used, it is possible to control the air-fuel ratio at a desired air-fuel ratio even if the fuel supply quantity required by the engine varies due to a change in the engine over time, etc.

(3) It is possible to prevent the misoperation of continuous fuel supply from occurring in the electromagnetic fuel injectors, while simultaneously effecting the above-described fuel injection control.

We claim:

1. A fuel injection control method for an internal combustion engine having electromagnetic fuel injectors to control an air-fuel ratio of said engine at a desired air-fuel ratio, said method comprising the steps of:

detecting conditions of operation parameters of said engine by respective sensors;

determining a basic fuel injection time width of a fuel injection pulse signal applied to said electromagnetic fuel injectors in accordance with the detected conditions of said engine operation parameters;

storing maximum fuel injection time width values predetermined in correspondence to values of a predetermined one of said engine operation parameters;

reading one of said predetermined maximum fuel injection time width values, corresponding to the values of said predetermined one of said engine operation parameters, after a predetermined time elapses from the acceleration of said engine from the idling condition and correcting the same in accordance with the values of the other ones of said engine operation parameters; and correcting said basic fuel injection time width in accordance with said corrected predetermined maximum fuel injection time width value.

2. A method according to claim 1, wherein said operation parameters of said engine include the engine speed, throttle value opening, intake pipe pressure, intake air quantity and any combination thereof.

3. A method according to claim 1, wherein said predetermined one of said engine operation parameters is the engine speed, and the other ones of said engine operation parameters used for correcting said one of said predetermined maximum fuel injection time width values include the atmospheric pressure, engine cooling water temperature, intake air temperature and engine idling condition.

* * * * *